US007645145B2

(12) United States Patent
Soma et al.

(10) Patent No.: US 7,645,145 B2
(45) Date of Patent: Jan. 12, 2010

(54) COMPOSITE PLUG AND ELECTRIC CIRCUIT SYSTEM

(75) Inventors: Takaya Soma, Toyota (JP); Hiroshi Yoshida, Anjo (JP); Takeshi Mogari, Nagoya (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 12/226,866

(22) PCT Filed: Aug. 28, 2007

(86) PCT No.: PCT/JP2007/067108

§ 371 (c)(1),
(2), (4) Date: Oct. 30, 2008

(87) PCT Pub. No.: WO2008/032595

PCT Pub. Date: Mar. 20, 2008

(65) Prior Publication Data

US 2009/0075520 A1 Mar. 19, 2009

(30) Foreign Application Priority Data

Sep. 11, 2006 (JP) ..... 2006-245847

(51) Int. Cl.
*H01R 12/00* (2006.01)

(52) U.S. Cl. ..... 439/76.2; 439/34; 439/511

(58) Field of Classification Search ..... 439/34, 439/76.2, 511

See application file for complete search history.

(56) References Cited

U.S. PATENT DOCUMENTS

| | | | | |
|---|---|---|---|---|
| 4,089,041 | A * | 5/1978 | Lockard | 361/767 |
| 4,128,291 | A * | 12/1978 | Peterson, Jr. | 439/786 |
| 5,971,801 | A | 10/1999 | Kato et al. | |
| 6,062,899 | A * | 5/2000 | Presley et al. | 439/489 |
| 6,548,972 | B2 * | 4/2003 | Takagi | 318/293 |
| 6,790,005 | B2 * | 9/2004 | Lee et al. | 416/97 R |
| 6,957,974 | B2 * | 10/2005 | Bruski et al. | 439/344 |
| 7,131,863 | B2 * | 11/2006 | Lebo et al. | 439/507 |

FOREIGN PATENT DOCUMENTS

| | | |
|---|---|---|
| JP | U-07-032882 | 6/1995 |
| JP | A-10-144429 | 5/1998 |
| JP | A-2004-114775 | 4/2004 |
| JP | A-2006-327251 | 12/2006 |

* cited by examiner

*Primary Examiner*—Truc T Nguyen
(74) *Attorney, Agent, or Firm*—Oliff & Berridge, PLC

(57) ABSTRACT

Provided is a plug wherein a plurality of points in an electric circuit can be easily put into a conductive state or a nonconductive state. A system wherein such a plug is applied is also provided. The composite plug is provided with a plurality of plugs, each of which is provided with two conductive pieces connected by a conductive member. A current is carried between the two circuit terminals when the two conductive pieces are brought into contact with two circuit terminals included in the electric circuit, respectively. A current is not carried between the two circuit terminals when the two conductive pieces are separated from the two circuit terminals included in the electric circuit, respectively. The plugs are attached to a common case body.

6 Claims, 6 Drawing Sheets

(b)

(a)

COMPOSITE PLUG AND ELECTRIC CIRCUIT SYSTEM

TECHNICAL FIELD

The present invention relates to a plug for making a part of an electric circuit be in a conductive state or a nonconductive state, and a system in which the foregoing plug is applied.

BACKGROUND ART

A vehicle driven by a motor is widely used. The foregoing vehicle is equipped with a battery for supplying electric power to the motor, and a power adjusting circuit for adjusting the electric power output by the battery to supply the adjusted electric power to the motor.

Japanese Patent Laid-Open Publication No. 2004-114775 discloses related art of the present invention.

DISCLOSURE OF THE INVENTION

A battery mounted on a vehicle outputs a high voltage for supplying the electric power necessary for driving the vehicle. Accordingly, it is preferable for the battery and a power adjusting circuit to have a configuration capable of avoiding problems caused by short circuits and the like of areas where high voltages are applied in operations of exchange of parts, inspection, repair, and the like.

The present invention was made in view of the foregoing problem, and provides a plug enabling making a plurality of points of an electric circuit be in a conductive state or a nonconductive state easily, and a system to which this sort of plug is applied.

Preferably, a composite plug according to the present invention includes a plurality of plugs, each plug equipped with two conductive pieces connected with each other with a conductive member, the plug causing two circuit terminals included in an electric circuit to be in a conductive state with each other by making the two conductive pieces contact with the two circuit terminals, respectively, the plug causing the two circuit terminals included in the electric circuit to be in a nonconductive state with each other by making the two conductive pieces be separated from the two circuit terminals, respectively, wherein a first plug, being one of the plurality of plugs, causes two circuit terminals included in a first power circuit to be in a conductive state or a nonconductive state with each other, the first power circuit supplying electric power to a motor for driving a vehicle; a second plug, being other than the first plug, and being one of the plurality of plugs, causes two circuit terminals included in a second power circuit to be in a conductive state or a nonconductive state with each other, the second power circuit provided separately from the first power circuit in order to increase the electric power to be supplied to the motor; and the plurality of plugs are fixed to a shared fixing member.

Moreover, in a composite plug according to the present invention, preferably, the first power circuit includes a battery for supplying the electric power to the motor, and the battery is equipped with two circuit terminals for making the battery output no voltage when the two circuit terminals are caused to be in a nonconductive state with each other, and for making the battery output a voltage when the two circuit terminals are caused to be in a conductive state with each other.

Moreover, in a composite plug according to the present invention, preferably, the second power circuit is equipped with a capacitor for storing the electric power to be supplied to the motor, and the capacitor is equipped with two circuit terminals for making the capacitor be in a state of not performing any charge or discharge of electric charge when the two circuit terminals are caused to be in a nonconductive state with each other, and for making the capacitor be in a state of performing charge or discharge of electric charge when the two circuit terminals are caused to be in a conductive state with each other.

Moreover, in a composite plug according to the present invention, preferably, each of the first power circuit and the second power circuit is equipped with a battery for supplying the electric power to the motor, and the battery is equipped with two circuit terminals for making the battery output no voltage when the two circuit terminals are caused to be in a nonconductive state with each other, and for making the battery output a voltage when the two circuit terminals are caused to be in a conductive state.

Moreover, in a composite plug according to the present invention, preferably, the conductive member is a fuse that is put in its cut-off state by a flow of a predetermined current.

Moreover, preferably, an electric circuit system according to the present invention includes the composite plug, the first power circuit, the second power circuit, and an electric circuit housing for housing the first power circuit and the second power circuit, wherein, when the composite plug is mounted on the electric circuit housing, the first plug causes the two circuit terminals included in the first power circuit to be in a conductive state with each other, and the second plug causes the two circuit terminals included in the second power circuit to be in a conductive state with each other; and, when the composite plug is removed from the electric circuit housing, the first plug causes the two circuit terminals included in the first power circuit to be in a nonconductive state with each other, and the second plug causes the two circuit terminals included in the second power circuit to be in a nonconductive state with each other.

According to the present invention, it is possible to cause a plurality of points of an electric circuit to be in a conductive state or a nonconductive state easily.

BEST MODE FOR CARRYING OUT THE INVENTION

Figure 1:
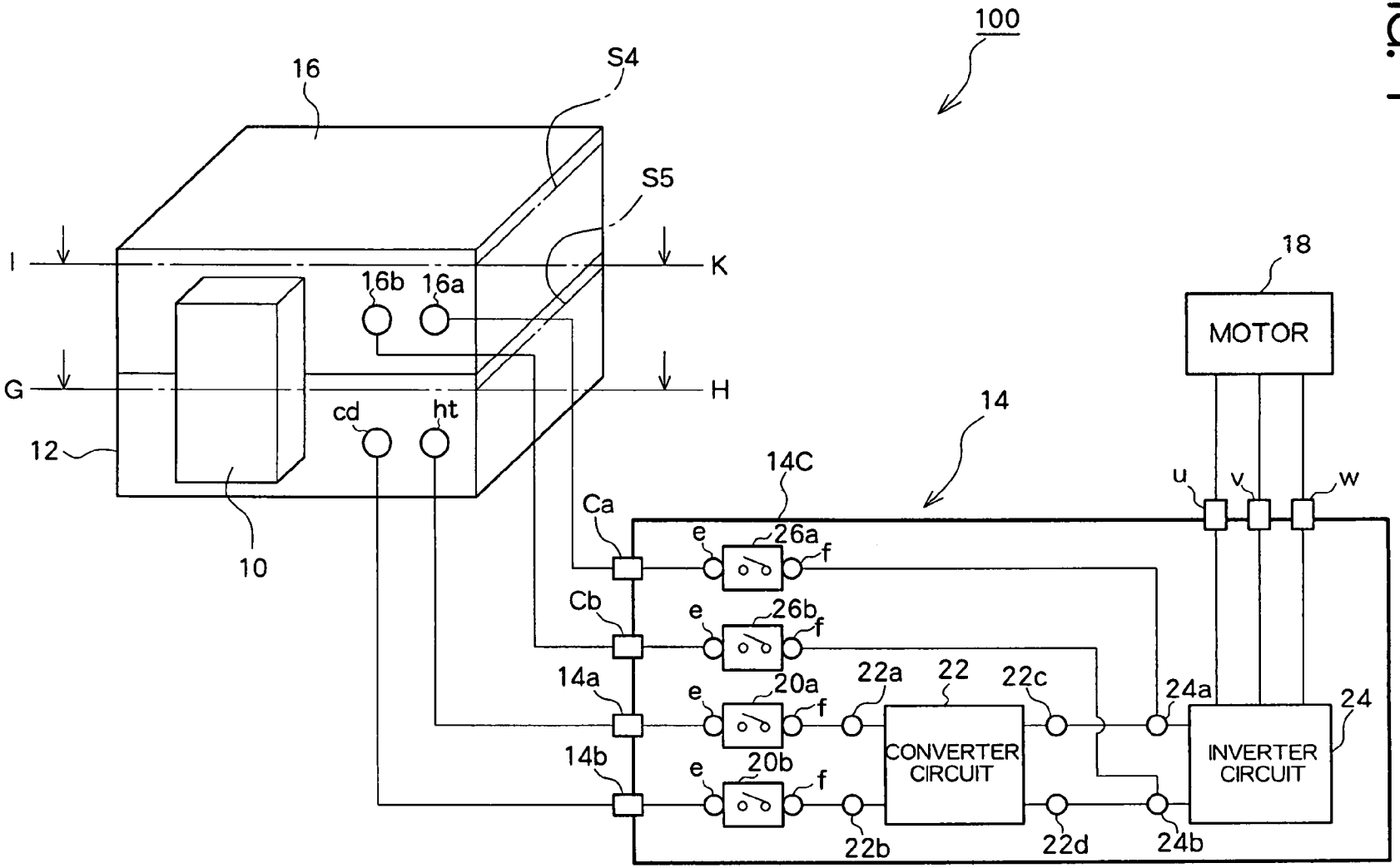
FIG. 1 is a view showing a vehicle driving system according to a first embodiment.

FIG. 1 shows the configuration of a vehicle driving system 100 according to a first embodiment of the present invention. The vehicle driving system 100 is composed of a composite plug 10, a battery unit 12, a power circuit unit 14, a capacitor unit 16, and a motor 18. The battery unit 12 and the capacitor unit 16 are arranged at predetermined positions close to each other. The composite plug 10 is attached to the battery unit 12 and the capacitor unit 16 in a mode that will be described below.

Figure 2:
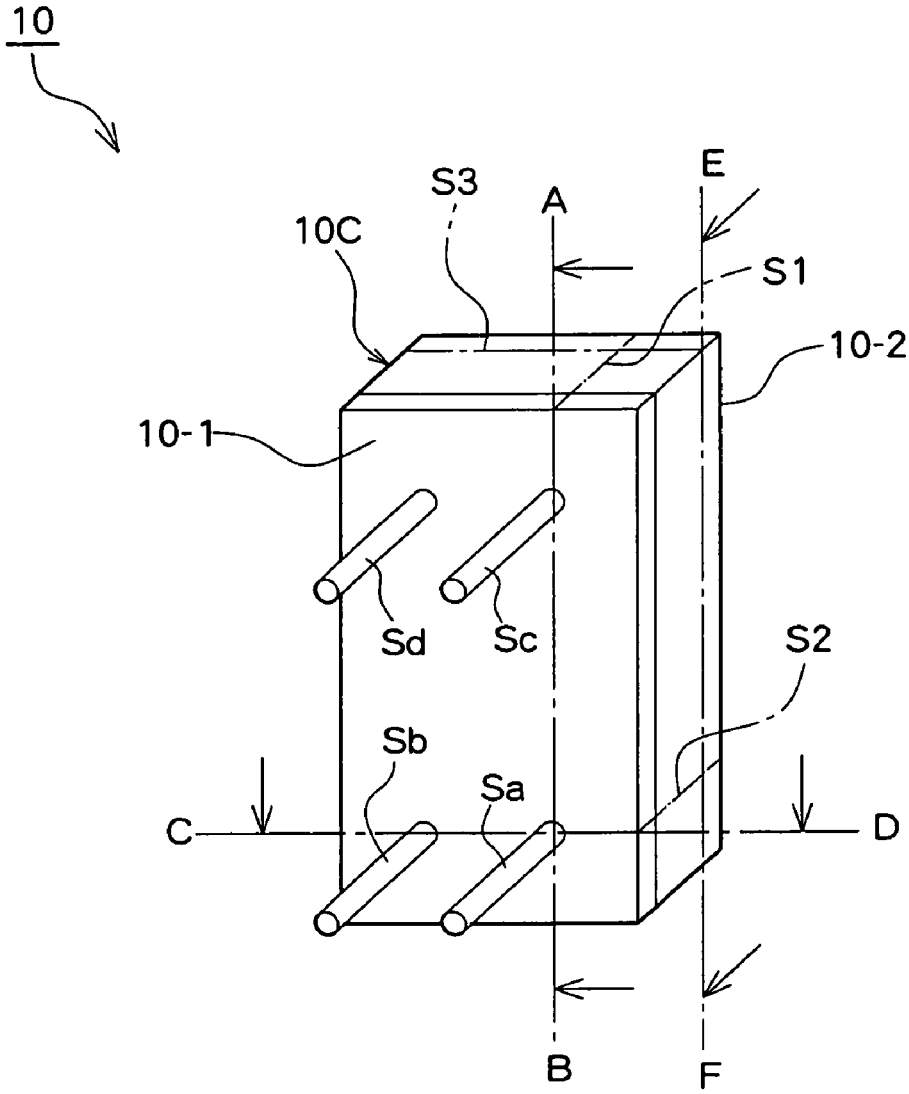
FIG. 2 is a view showing the configuration of a composite plug.
Figure 3:
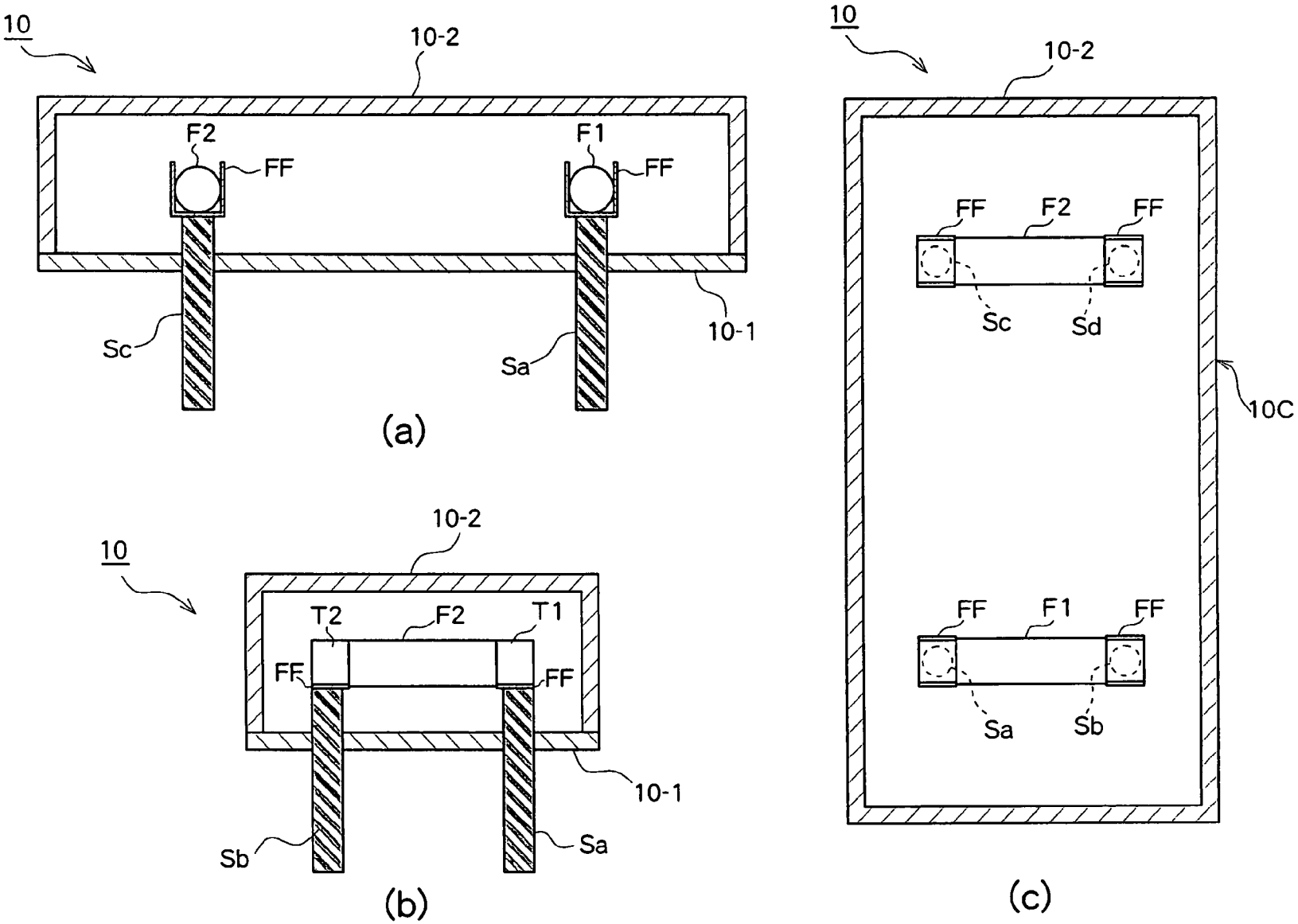
FIG. 3 is a view showing the inner part of the composite plug.

FIG. 2 shows a perspective view of the composite plug 10. Moreover, FIG. 3(*a*) shows a view illustrating the inner part of the composite plug 10 when it is seen from a cross section S1 including a straight line AB drawn by an alternate long and short dash line in FIG. 2; FIG. 3(*b*) shows a view illustrating the inner part of the composite plug 10 when it is seen from a cross section S2 including a straight line CD drawn by an alternate long and short dash line in FIG. 2; and FIG. 3(*c*) shows a view illustrating the inner part of the composite plug 10 when it is seen from a cross section S3 including a straight line EF drawn by an alternate long and short dash line in FIG. 2.

The composite plug 10 is composed of a plug case 10C, conducting bars Sa, Sb, Sc, and Sd, and fuses F1 and F2.

Each of conducting bars Sa, Sb, Sc, and Sd is made of a conductive material, such as a metal. The shape of the cross section thereof perpendicular to a drawing direction can be an arbitrary one, and it is assumed that the shape is a circle here. A fuse fixing unit FF for attaching a fuse is formed at one end of each of the conducting bars Sa, Sb, Sc, and Sd. The fuse fixing unit FF can be formed by means of a U-shaped member formed by opposing a pair of rectangular metal flat plates parallel to each other and by joining adjacent edges of the two opposed flat plates with another rectangular metal flat plate.

The plug case 10C is composed of a flat plate portion 10-1 and a container portion 10-2. It is suitable to form the flat plate portion 10-1 and the container portion 10-2 of an insulating material, such as plastic and porcelain.

The conducting bars Sa, Sb, Sc, and Sd are attached onto the flat plate portion 10-1. The conducting bars Sa, Sb, Sc, and Sd penetrate the flat plate portion 10-1 so that the ends at which the fuse fixing units FF are provided may be housed in the plug case 10C. The respective parts of the conducting bars Sa and Sb that protrude to the outside of the plug case 10C are inserted into jacks for fixing the conducting bars, these jacks being formed on the battery unit 12. The respective parts of the conducting bars Sc and Sd that protrude to the outside of the plug case 10C are inserted into jacks for fixing the conducting bars, these jacks being provided on the capacitor unit 16. Accordingly, the positions of the conducting bars Sa, Sb, Sc, and Sd are determined on the basis of the positions of the jacks provided on the battery unit 12, the positions of the jacks provided on the capacitor unit 16, and the arrangement of the battery unit 12 and the capacitor unit 16. Furthermore, the shape of the flat plate portion 10-1 is determined on the basis of the arrangement of the conducting bars Sa, Sb, Sc, and Sd.

The container portion 10-2 is formed in a shape of a container having an opening of the same shape as that of the flat plate portion 10-1. The flat plate portion 10-1 is joined with the opening of the container portion 10-2, and the flat plate portion 10-1 and container portion 10-2 form a case.

The fuse F1 is equipped with terminals T1 and T2. The terminals T1 and T2 are fixed to the fuse fixing units FF of the conducting bars Sa and Sb, respectively, in the state of realizing electric contact between them. When the value of a current flowing through the terminals T1 and T2 exceeds a predetermined value, the fuse F1 enters its cut-off state. The fuse F2 has the same configuration and function as those of the fuse F1, and the terminals T1 and T2 are fixed to the fuse fixing units FF of the conducting bars Sc and Sd, respectively, in the state of realizing electric contact between them.

According to the foregoing configuration, the composite plug 10 can be attached to the battery unit 12 with the conducting bars Sa and Sb, and the composite plug 10 can be attached to the capacitor unit 16 with the conducting bars Sc and Sd.

Moreover, the fuse F1 is fixedly housed in the plug case 10C through the conducting bars Sa and Sb, and the fuse F2 is fixedly housed in the plug 10C through the conducting bars Sc and Sd. Then, the respective parts of the conducting bars Sa and Sb that protrude to the outside of the plug case 10C can be used as the terminals for the electrical connection to the fuse F1, and the respective parts of the conducting bar Sc and Sd that protrude to the outside of the plug case 10C can be used as the terminals for the electrical connection to the fuse F2.

Incidentally, the description has been given for the composite plug 10, in which the flat plate portion 10-1 is joined with the container portion 10-2 here. It is also possible to configure a composite plug composed of only a member for fixing conducting bars like the flat plate portion 10-1 without providing any cover, such as the container portion 10-2, besides the foregoing composite plug 10.

Figure 4:
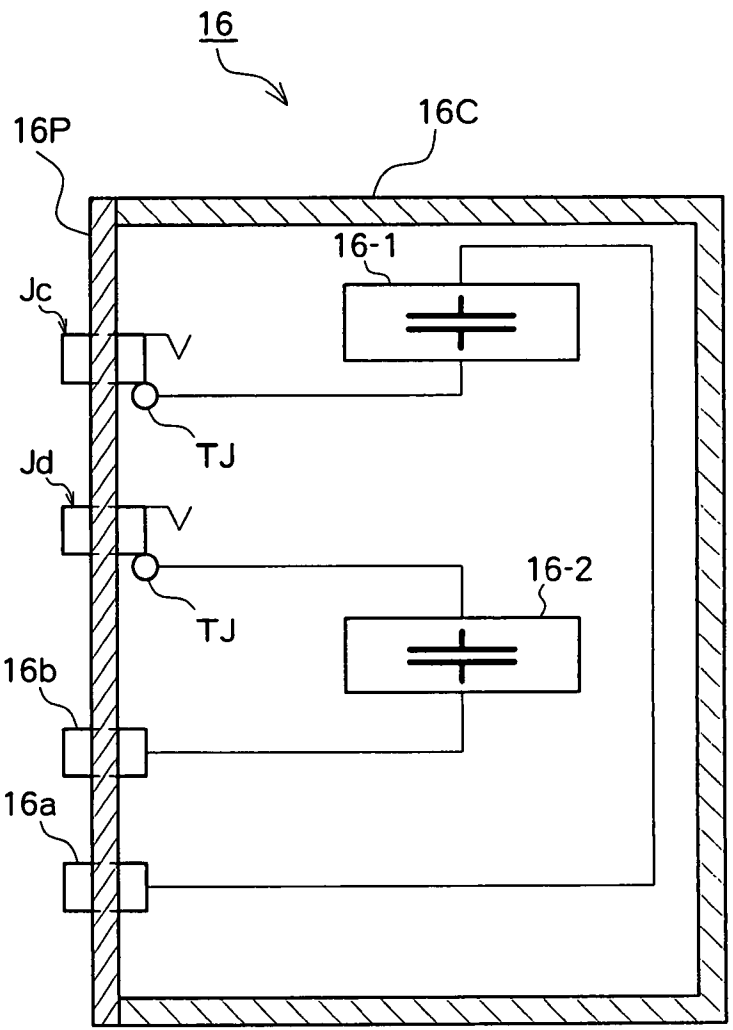
FIG. 4 is a view showing the inner parts of a battery unit and a capacitor unit.
Figure 4:
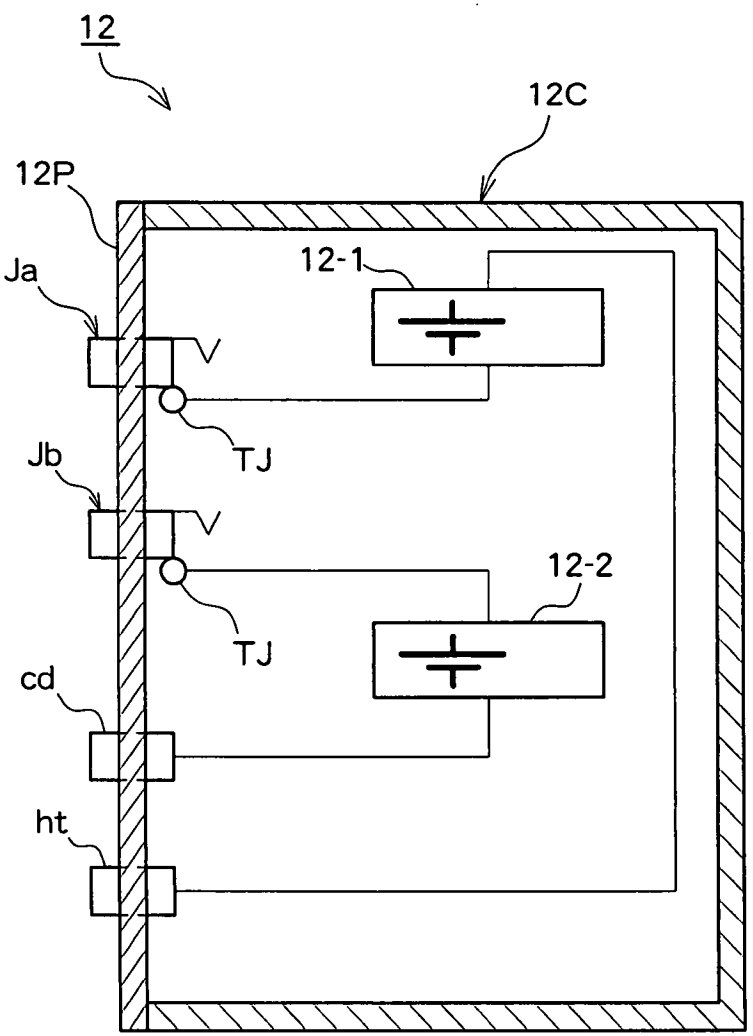

FIG. 4(*a*) shows a view illustrating the inner part of the battery unit 12 when it is seen from a cross section S5 including a straight line GH drawn by an alternate long and short dash line in FIG. 1.

The battery unit 12 is composed of a battery case 12C, jacks Ja and Jb, battery blocks 12-1 and 12-2, and battery terminals ht and cd.

The battery case 12C is formed in a shape enabling the battery case 12C to be arranged close to the capacitor unit 16. In the present embodiment, the battery case 12C is formed in a hexahedral shape including a terminal attaching plate 12P as one of the surfaces of the shape. The jacks Ja and Jb and the battery terminals ht and cd are attached onto the terminal attaching plate 12P.

Figure 5:
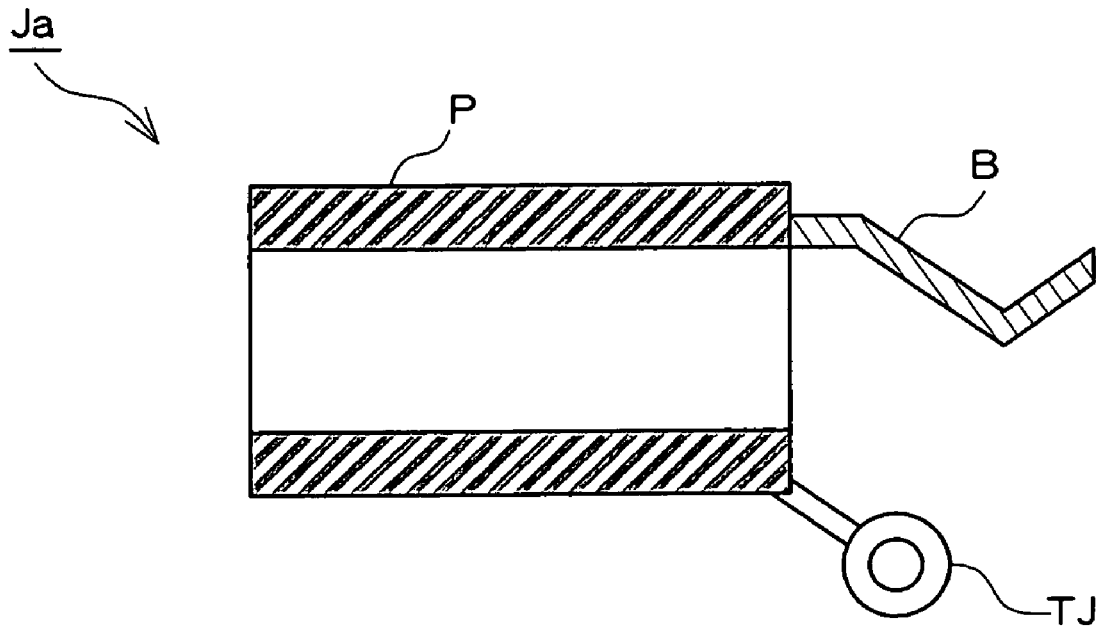
FIG. 5 is a view showing a configuration example of a jack.

The jacks Ja and Jb are attached onto the terminal attaching plate 12P with the same distance between them as that between the conducting bars Sa and Sb. FIG. 5 shows a configuration example of the jack Ja by means of a sectional view. The jack Ja is equipped with a conductive pipe P, a jack terminal TJ, and a spring section B. The conductive pipe P is formed in a tubular shape made of a conductor. The shape of the cross section of the conductive pipe P perpendicular to the drawing direction thereof is formed to be the same as that of the cross section of the conducting bar of the composite plug 10. The conductive pipe P is attached to the terminal attaching plate 12P with the opening of the conductive pipe P on one side facing the outside of the battery case 12C. The jack terminal TJ and the spring section B are attached to the end of the conductive pipe P on the opposite side to the side that is facing to the outside of the battery case 12C. The conducting bar Sa of the composite plug is inserted into the conductive pipe P, and the conducting bar Sa contacts with the spring section B, which fixes the conducting bar Sa by urging force. As a result, the jack terminal TJ and the conducting bar Sa are electrically connected to each other. The jack Jb has the same configuration and function as those of the jack Ja, and the conducting bar Sb of the composite plug 10 is inserted into the jack Jb.

The composite plug 10 can be attached to the battery unit 12 in the foregoing configuration. The jack terminal TJ of the jack Ja and the jack terminal TJ of the jack Jb are caused to be in a conducted state with each other through the fuse F1 by the attachment of the composite plug 10.

The battery blocks 12-1 and 12-2 are fixedly housed in the battery case 12C. Each of the battery blocks 12-1 and 12-2 independently functions as one battery. The terminal on the higher electric potential side of the battery block 12-1 is connected to the battery terminal ht, and the terminal of the lower electric potential side of the battery block 12-1 is connected to the terminal TJ of the jack Ja. The terminal on the higher electric potential side of the battery block 12-2 is connected to the terminal TJ of the jack Jb, and the terminal on the lower electric potential side of the battery block 12-2 is connected to the battery terminal cd.

In the state where the composite plug 10 is attached to the battery unit 12, the battery block 12-1 and the battery block 12-2 are connected to each other in series through the jacks Ja and Jb. In this state, the battery unit 12 outputs a voltage corresponding to the sum of the output voltages of the battery blocks 12-1 and 12-2 from both of the battery terminals ht and cd.

The battery unit 12 increases a voltage to be output by the serial connection of the battery blocks 12-1 and 12-2. The battery unit 12 can also be configured to include three or more serially connected battery blocks. In this case, the battery unit 12 may be configured to connect two of the three or more battery blocks in series through the jacks Ja and Jb.

The power circuit unit 14 is composed of a circuit case 14C, power terminals 14*a* and 14*b*, switches 20*a*, 20*b*, 26*a*, and 26*b*, a converter circuit 22, an inverter circuit 24, alternating-current terminals u, v, and w, and capacitor connecting terminals Ca and Cb.

The circuit case 14C fixedly houses the switches 20*a*, 20*b*, 26*a*, and 26*b*, the converter circuit 22, and the inverter circuit 24 therein. The power terminals 14*a* and 14*b*, the alternating-current terminals u, v, and w, and the capacitor connecting terminals Ca and Cb, are attached to the circuit case 14C.

The switch 20*a* is equipped with terminals e and f. The switch 20*a* selects either of the conductive state between the terminals e and f and the cut-off state between the terminals e and f. Each of the switches 20*b*, 26*a*, and 26*b* has the same configuration and function as those of the switch 20*a*.

The converter circuit 22 is equipped with terminals 22*a*, 22*b*, 22*c*, and 22*d*. The converter circuit 22 boosts the voltage applied between the terminals 22*a* and 22*b* to output the boosted voltage between the terminals 22*c* and 22*d*.

The inverter circuit 24 is equipped with direct-current terminals 24*a* and 24*b*. The inverter circuit 24 converts a direct-current voltage applied between the direct-current terminals 24*a* and 24*b* into a three-phase alternating-current voltage to output the converted three-phase alternating current to the alternating-current terminals u, v, and w.

A description is given to an electric connection of each configuration unit of the power circuit unit 14. The terminal e of the switch 20*a* is connected to the power terminal 14*a*, and the terminal e of the switch 20*b* is connected to the power terminal 14*b*. The terminal f of the switch 20*a* is connected to the terminal 22*a* of the converter circuit 22, and the terminal f of the switch 20*b* is connected to the terminal 22*b* of the converter circuit 22. The terminal 22*c* of the converter circuit 22 is connected to the direct-current terminal 24*a* of the inverter circuit 24, and the terminal 22*d* of the converter circuit 22 is connected to the direct-current terminal 24*b* of the inverter circuit 24. The terminal e of the switch 26*a* is connected to the capacitor connecting terminal Ca, and the terminal e of the switch 26*b* is connected to the capacitor connecting terminal Cb. The terminal f of the switch 26*a* is connected to the direct-current terminal 24*a* of the inverter circuit 24, and the terminal f of the switch 26*b* is connected to the terminal 24*b* of the inverter circuit 24.

A description is given to the operation of the power circuit unit 14 when the switches 20*a*, 20*b*, 26*a*, and 26*b* are put into their conductive states. The voltage applied between the power terminals 14*a* and 14*b* is applied between the terminals 22*a* and 22*b* of the converter circuit 22 through the switches 20*a* and 20*b*. The converter circuit 22 outputs a boosted voltage to both of the direct-current terminals 24*a* and 24*b*. Moreover, the converter circuit 22 outputs the boosted voltage between the capacitor connecting terminals Ca and Cb through the switches 26*a* and 26*b*, respectively. The inverter circuit 24 converts the voltage applied between the direct-current terminals 24*a* and 24*b* into a three-phase alternating-current voltage, and output the converted three-phase alternating-current voltage to the alternating-current terminals u, v, and w.

FIG. 4(*b*) shows a view illustrating the inner part of the capacitor unit 16 when it is seen from a cross section S4 including a straight line IK drawn by an alternate long and short dash line in FIG. 1.

The capacitor unit 16 is composed of a capacitor case 16C, capacitors 16-1 and 16-2, jacks Jc and Jd, and terminals 16*a* and 16*b*. The capacitor unit 16 increases the electric power that the power circuit unit 14 can output by being connected to the inverter circuit 24 from the outside of the power circuit unit 14.

The capacitor case 16C is formed in a shape enabling the capacitor case 16C to be arranged close to the battery unit 12. In the present embodiment, the capacitor case 16C is formed in a hexahedral shape including a terminal attaching plate 16P as one of the surfaces of the shape. The jacks Jc and Jd and the terminals 16*a* and 16*b* are attached onto the terminal attaching plate 16P.

Each of the jacks Jc and Jd has the same configuration and function as those of the jack Ja of the battery unit 12. The conducting bars Sc and Sd of the composite plug 10 are inserted into the jacks Jc and Jd, respectively. The jacks Jc and Jd are attached to the terminal attaching plate 16P with the same distance between them as that between the conducting bars Sc and Sd so that the conducting bars Sc and Sd can be inserted into the jacks Jc and Jd, respectively, in the state in which the battery unit 12 and the capacitor unit 16 are arranged to be superposed on each other.

With the foregoing configuration, it becomes possible to attach the composite plug 10 to the capacitor unit 16. As a result of the attachment of the composite plug 10, the jack terminal TJ of the jack Jc and the jack terminal TJ of the jack Jd are caused to be in a conductive state with each other through the fuse F2.

The capacitors 16-1 and 16-2 are fixedly housed in the capacitor case 16C. The terminal on one side of the capacitor 16-1 is connected to the terminal 16*a*, and the terminal to which the terminal 16*a* is not connected is connected to the terminal TJ of the jack Jc. The terminal on one side of the capacitor 16-2 is connected to the capacitor terminal 16*b*, and the terminal to which the capacitor terminal 16*b* is not connected is connected to the terminal Tj of the jack Jd.

In the state where the composite plug 10 is attached to the capacitor unit 16, the capacitor 16-1 and the capacitor 16-2 are connected to each other in series through the jacks Jc and Jd. In this state, the capacitor unit 16 can charge itself with electric charge or discharge the charged electric charge.

Because the capacitors 16-1 and 16-2 are serially connected to each other in the capacitor unit 16, the withstand voltage required for each of the capacitors 16-1 and 16-2 can be reduced. The capacitor unit 16 can be also configured to include three or more serially connected capacitors. In this case, the capacitor unit 16 may be configured to connect two of the three or more capacitors in series through the jacks Jc and Jd.

A description is given of the electric connection and the operation of the battery unit 12, the power circuit unit 14, the capacitor unit 16, and the motor 18 with reference to FIG. 1.

The battery terminals ht and cd of the battery unit 12 are connected to the power terminals 14*a* and 14*b* of the power circuit unit 14, respectively. The motor 18 is connected to the alternating-current terminals u, v, and w of the power circuit unit 14.

The battery unit 12 and the capacitor unit 16 are arranged so that the composite plug 10 can be attached to them. In the present embodiment, the composite plug 10 can be attached to them in the state where the capacitor unit 16 is arranged to be superposed on the battery unit 12.

The composite plug 10 is made to be in the state of being attached to the battery unit 12 and the capacitor unit 16 except for the cases of performing exchanges of the battery unit 12, capacitor unit 16, and the like, and an inspection, a repair, and the like, of the vehicle driving system 100.

When the vehicle is made to travel, the switches 20*a*, 20*b*, 26*a*, and 26*b* of the power circuit unit 14 are caused to be in their conductive state. The battery unit 12 applies a voltage between the power terminals 14*a* and 14*b* of the power circuit unit 14. The power circuit unit 14 boosts the applied voltage to charge the capacitor unit 16, and converts the boosted voltage and the voltage charged in the capacitor unit 16 into a three-phase alternating-current voltage to output the converted three-phase alternating-current voltage to the motor 18 through the alternating-current terminals u, v, and w. The motor 18 rotates on the basis of the three-phase alternating-current voltage to make the vehicle travel.

At the time of performing exchange of the battery unit 12, the capacitor unit 16, and the like, and inspection, repair, and the like, of the vehicle driving system 100, the switches 20*a*, 20*b*, 26*a*, and 26*b* are put in their cut-off states, and the composite plug 10 is removed from the battery unit 12 and the capacitor unit 16. Thereby, the battery blocks 12-1 and 12-2 are separated from each other, and the battery terminals ht and cd are in the state where no voltage is output from them. Furthermore, the capacitors 16-1 and 16-2 are separated from each other, and the terminals 16*a* and 16*b* are in the state in which where no voltage is output from them even if electric charge remains in the capacitors 16-1 and 16-2.

According to the foregoing configuration, the battery unit 12 and the capacitor unit 16 can be put in the state of outputting no voltages by a simple operation of removing the composite plug 10. Hereby, a problem owing to a short circuit or the like in an area to which a high voltage is applied can be avoided in the operations of the exchange of the battery unit 12, the capacitor unit 16, and the like, and inspection, repair, and the like, of the power driving system 100. Moreover, for example, even if a problem with the switch 20*a*, 20*b*, 26*a*, or 26*b* arises in which it does not change to its cut-off state, a problem owing to the short circuit of an area where a high voltage is applied can be avoided at the time of inspection, repair, or the like, of the power circuit unit 14.

Furthermore, if a cut-off state is caused by a predetermined value or more of current flowing through a fuse provided in the composite plug 10 owing to a problem of a circuit included in the vehicle driving system 100, or the like, then the battery unit 12 or the capacitor unit 16 is put in the state of outputting no voltage. As a result, secondary problems of the vehicle driving system 100 can be avoided.

Figure 6:
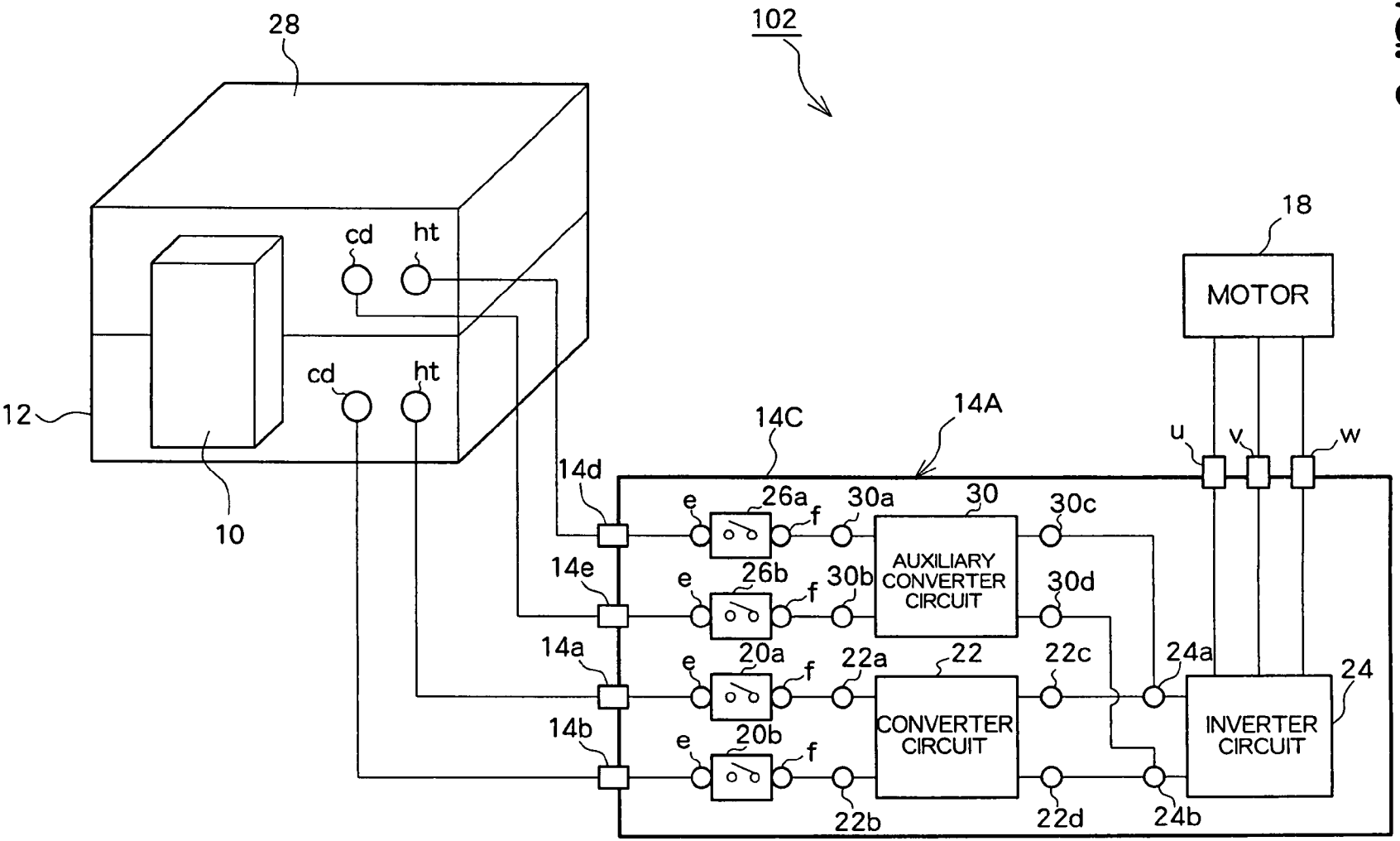
FIG. 6 is a view showing a vehicle driving system according to a second embodiment.

Next, a description is given of a vehicle driving system 102 of a second embodiment of the present invention. FIG. 6 shows the configuration of the vehicle driving system 102. The vehicle driving system 102 is composed of the composite plug 10, the battery unit 12, an auxiliary battery unit 28, a power circuit unit 14A, and the motor 18.

The vehicle driving system 102 is configured by replacing the power circuit unit 14 and the capacitor unit 16 of the vehicle driving system 100 with the power circuit unit 14A and the auxiliary battery unit 28, respectively. The same configuration parts as those of the vehicle driving system 100 shown in FIG. 1 are denoted by the same reference numerals as those of the vehicle driving system 100, and their descriptions are omitted.

The auxiliary battery unit 28 has the same configuration and function as those of the battery unit 12. The shapes of the flat plate portion 10-1 and the container portion 10-2, the arrangement of the conductive bars Sa, Sb, Sc and Sd, and the like, of the composite plug 10 are determined so that the composite plug 10 can be attached to the battery unit 12 and the auxiliary battery unit 28 in the state in which the auxiliary battery unit 28 is arranged by being superposed on the battery unit 12.

The power circuit unit 14A is composed of the circuit case 14C, the power terminals 14*a* and 14*b*, auxiliary power terminals 14*d* and 14*e*, the switches 20*a*, 20*b*, 26*a*, and 26*b*, the converter circuit 22, an auxiliary converter circuit 30, the inverter circuit 24, and the alternating-current terminals u, v, and w. The power circuit unit 14A is configured by adding the auxiliary converter circuit 30 to the power circuit unit 14, and by replacing the capacitor connecting terminals Ca and Cb with the auxiliary power terminals 14*d* and 14*e*, respectively. The same structural parts of the power circuit unit 14A as those of the power circuit unit 14 are denoted by the same reference numerals as those of the power circuit unit 14, and their descriptions are omitted.

The switches 26*a* and 26*b* and the auxiliary converter circuit 30 are fixedly housed in the circuit case 14C. The switches 26*a* and 26*b* have the same configuration and function as those of the switch 20*a*. The auxiliary converter circuit 30 has the same configuration and function as those of the converter circuit 22. The terminal e of the switch 26*a* is connected to the auxiliary power terminal 14*d*, and the terminal e of the switch 26*b* is connected to the auxiliary power terminal 14*d*. The terminal f of the switch 26*a* is connected to a terminal 30*a* of the auxiliary converter circuit 30, and the terminal f of the switch 26*b* is connected to a terminal 30*b* of the auxiliary converter circuit 30. A terminal 30*c* of the auxiliary converter circuit 30 is connected to the direct-current terminal 24*a* of the inverter circuit 24, and a terminal 30*d* of the auxiliary converter circuit 30 is connected to the direct-current terminal 24*b* of the inverter circuit 24.

A description is given of the operation when the switches 26*a* and 26*b* are put in their conductive states. A voltage applied between the auxiliary power terminals 14*d* and 14*e* is applied between the terminals 30*a* and 30*b* of the auxiliary converter circuit 30 through the switches 26*a* and 26*b*. The auxiliary converter circuit 30 boosts the applied voltage to output the boosted voltage between the direct-current terminals 24*a* and 24*b*.

Because the auxiliary converter circuit 30 is added in the power circuit unit 14A, the power circuit unit 14A can supply electric power larger than that supplied by the power circuit unit 14.

A description is given of the electric connection and operation of the battery unit 12, the auxiliary battery unit 28, the power circuit unit 14A, and the motor 18 with reference to FIG. 6.

The battery terminals ht and cd of the battery unit 12 are connected to the power terminals 14*a* and 14*b* of the power circuit unit 14A, respectively. The battery terminals ht and cd of the auxiliary battery unit 28 are connected to the auxiliary power terminals 14*d* and 14*e* of the power circuit unit 14A, respectively. The motor 18 is connected to the alternating-current terminals u, v, and w of the power circuit unit 14A.

When the vehicle is made to travel, the switches 20*a*, 20*b*, 26*a*, and 26*b* of the power circuit unit 14A are put in their conductive states. The battery unit 12 applies a voltage between the power terminals 14*a* and 14*b* of the power circuit unit 14A. The auxiliary battery unit 28 applies a voltage between the auxiliary power terminals 14*d* and 14*e* of the power circuit unit 14A. The power circuit unit 14A boosts the applied voltages to convert the boosted voltages to three-phase alternating-current voltages, and outputs the converted three-phase alternating-current voltages to the motor 18 through the alternating-current terminals u, v, and w. The motor 18 rotates on the basis of the three-phase alternating-current voltages to make the vehicle travel.

At the time of performing exchange of the battery unit 12, the auxiliary battery unit 28, and the like, and inspection, repair, and the like, of the vehicle driving system 102, the switches 20*a*, 20*b*, 26*a*, and 26*b* are turned to their cut-off states, and the composite plug 10 is removed from the battery unit 12 and the auxiliary battery unit 28. As a result, the battery unit 12 and the auxiliary battery unit 28 are placed in the state of outputting no voltages.

According to the foregoing configuration, it is possible to make the battery unit 12 and the auxiliary battery unit 28 be in the state of outputting no voltages by a simple operation of removing the composite plug 10. As a result, a problem caused by a short circuit and the like in an area where a high voltage is applied can be avoided at the time of performing the operations of the exchanges of the battery unit 12, the auxiliary battery unit 28, and the like, and inspection, repair, and the like, of the vehicle driving system 102.

In the above description, the configuration of setting two points in the circuit included in the battery unit 12, the capacitor unit 16, or the auxiliary battery unit 28, to be in a conductive states or a nonconductive states by attaching or removing the composite plug 10, respectively, has been described. The present invention is not limited to the foregoing embodiments, but the present invention can be applied to a configuration of setting two arbitrary points of the electric circuit to be in a conductive states or a nonconductive states.

Furthermore, by increasing the pairs of conducting bars attached to the composite plug, the present invention can be configured so as to set three or more points to be in a conductive states or a nonconductive states. For example, if the capacitor unit 16 is further added to be connected between the direct-current terminals 24*a* and 24*b* of the inverter circuit 24 in order to enlarge the electric power capable of being supplied to the motor 18, then it is necessary to set the conductive state or the nonconductive state between the jacks Jc and Jd of the added capacitor unit 16. Also in the foregoing case, it becomes possible to set the conductive state or the nonconductive state between the jacks Jc and Jd of the added capacitor unit 16 by increasing the pairs of conducting bars attached to the composite plug. The situation is also applied to the case where the converter circuit 22 connected to the auxiliary battery unit 28 is added to be connected between the direct-current terminals 24*a* and 24*b* of the inverter circuit 24. Moreover, although the configuration has been described with respect to the configuration in which the composite plug is provided with the fuse, the configuration in which the fuse is replaced by a conducting wire in an area of a circuit in which the probability of problems is low may be adopted.

Moreover, in the first embodiment, the battery unit 12 and the capacitor unit 16 are formed to be placed in separated cases. Besides the foregoing configuration, the configuration in which the battery unit 12 and the capacitor unit 16 are housed in a shared case and the conducting bars of the composite plug are arranged according to the arrangement of jacks is also possible. Similarly, in the second embodiment, the battery unit 12 and the auxiliary battery unit 28 can be configured to be housed in a shared case.

Incidentally, the present invention can also be applied to a vehicle driving system in which the motor is replaced by a motor generator having the functions of a motor and a generator, and the electric power generated by the motor generator on the basis of the travel of the vehicle is collected with the battery unit 12 or the auxiliary battery unit 28. In this case, the inverter circuit 24 converts a three-phase alternating-current voltage output from the motor generator into a direct-current voltage and outputs the converted direct-current voltage to the converter circuit 22 or the auxiliary converter circuit 30. The converter circuit 22 steps down the voltage to charge the battery unit 12. The auxiliary converter circuit 30 steps down the voltage to charge the auxiliary battery unit 28. Also in the foregoing configuration, it is possible to avoid a problem caused by a short circuit in an area where a high voltage is applied by removing the composite plug of the embodiment at the time of performing exchange of the battery unit 12, the auxiliary battery unit 28, and the like, and inspection, repair, and the like, of the power driving system.

What is claimed is:

1. A composite plug comprising a plurality of plugs, each plug equipped with two conductive pieces connected with each other by a conductive member, the plug causing two circuit terminals included in an electric circuit be in a conductive state with each other by making the two conductive pieces contact with the two circuit terminals, respectively, the plug causing the two circuit terminals included in the electric circuit be in a nonconductive state with each other by making the two conductive pieces be separated from the two circuit terminals, respectively, wherein a first plug, being one of the plurality of plugs, causes two circuit terminals included in a first power circuit to be in a conductive state or a nonconductive state with each other, the first power circuit supplying electric power to a motor for driving a vehicle;

a second plug other than the first plug, the second plug being one of the plurality of plugs, causes two circuit terminals included in a second power circuit to be in a conductive state or a nonconductive state with each other, the second power circuit provided separately from the first power circuit in order to increase the electric power to be supplied to the motor; and the plurality of plugs are fixed to a shared fixing member.

2. The composite plug according to claim 1, wherein the first power circuit includes a battery for supplying the electric power to the motor, and the battery is equipped with two circuit terminals for causing the battery to output no voltage when the two circuit terminals are caused to be in a nonconductive state with each other, and for causing the battery to output a voltage when the two circuit terminals are caused to be in a conductive state with each other.

3. The composite plug according to claim 1, wherein the second power circuit is equipped with a capacitor for storing the electric power to be supplied to the motor, and the capacitor is equipped with two circuit terminals for causing the capacitor be in a state of not performing any charge or discharge of electric charges when the two circuit terminals are put in a nonconductive state with each other, and for causing the capacitor be in a state of performing charge or discharge of electric charge when the two circuit terminals are put in a conductive state with each other.

4. The composite plug according to claim 1, wherein each of the first power circuit and the second power circuit is equipped with a battery for supplying the electric power to the motor, and the battery is equipped with two circuit terminals for causing the battery to output no voltage when the two circuit terminals are caused to be in a nonconductive state with each other, and for causing the battery to output a voltage when the two circuit terminals are caused to be in a conductive state.

5. The composite plug according to claim 1, wherein the conductive member is a fuse put in its cut-off state by a flow of a predetermined current.

6. An electric circuit system comprising the composite plug according to claim 1, the first power circuit, the second power circuit, and an electric circuit housing for housing the first power circuit and the second power circuit, wherein when the composite plug is mounted on the electric circuit housing, the first plug causes the two circuit terminals included in the first power circuit to be in a conductive state with each other, and the second plug causes the two circuit terminals included in the second power circuit to be in a conductive state with each other, and when the composite plug is removed from the electric circuit housing, the first plug causes the two circuit terminals included in the first power circuit to be in a nonconductive state with each other, and the second plug causes the two circuit terminals included in the second power circuit to be in a nonconductive state with each other.

* * * * *